US009052100B2

(12) United States Patent
Blackstone

(10) Patent No.: US 9,052,100 B2
(45) Date of Patent: Jun. 9, 2015

(54) COOPERATING LED DRIVER AND SOCKET

(71) Applicant: Michael A. Blackstone, Hanover, MD (US)

(72) Inventor: Michael A. Blackstone, Hanover, MD (US)

(73) Assignee: Rapid Electronics, LLC, Hanover, MD (US)

( * ) Notice: Subject to any disclaimer, the term of this patent is extended or adjusted under 35 U.S.C. 154(b) by 0 days.

(21) Appl. No.: 14/179,242

(22) Filed: Feb. 12, 2014

(65) Prior Publication Data

US 2014/0160741 A1 Jun. 12, 2014

Related U.S. Application Data

(63) Continuation-in-part of application No. 13/199,176, filed on Aug. 22, 2011, now Pat. No. 8,851,703.

(60) Provisional application No. 61/764,299, filed on Feb. 13, 2013, provisional application No. 61/402,442, filed on Aug. 30, 2010.

(51) Int. Cl.

| | |
|---|---|
| ***F21V 23/02*** | (2006.01) |
| ***F21V 23/00*** | (2006.01) |
| *F21Y 101/02* | (2006.01) |

(52) U.S. Cl.

CPC ..... *F21V 23/026* (2013.01); *F21V 23/008* (2013.01); *F21Y 2101/02* (2013.01)

(58) Field of Classification Search

CPC ..... F21V 23/02; F21V 23/008; F21V 23/026; F21Y 2101/02

USPC ..... 362/221, 222, 260, 265, 249.02

See application file for complete search history.

(56) References Cited

U.S. PATENT DOCUMENTS

| | | | | |
|---|---|---|---|---|
| 3,040,170 | A | 6/1962 | Chwan | |
| 3,183,346 | A | 5/1965 | Spaulding et al. | |
| 3,247,368 | A | 4/1966 | McHugh | |
| 3,433,887 | A | 3/1969 | Driskell | |
| 4,931,914 | A | 6/1990 | Quiogue | |
| 5,253,152 | A | 10/1993 | Yang et al. | |
| 5,292,260 | A | 3/1994 | Sinisi et al. | |
| 5,908,235 | A | 6/1999 | Petrozello et al. | |
| 6,102,550 | A | 8/2000 | Edwards, Jr. | |
| 7,090,390 | B2 | 8/2006 | Pazula | |
| D550,154 | S | 9/2007 | Pickard | |
| 7,950,822 | B2 | 5/2011 | Deng | |
| 8,523,383 | B1 * | 9/2013 | Grigore et al. | 362/221 |
| 2004/0076001 | A1 | 4/2004 | Lutes | |
| 2010/0319953 | A1 | 12/2010 | Yochum et al. | |

* cited by examiner

FOREIGN PATENT DOCUMENTS

| | | | |
|---|---|---|---|
| KR | 10-2008-0078519 | A | 8/2008 |
| KR | 10-2008-0091652 | A | 10/2008 |

*Primary Examiner* — Thomas M Sember

(74) *Attorney, Agent, or Firm* — Rosenberg, Klein & Lee

(57) ABSTRACT

A system for replacing an LED driver of an LED fixture without having to wire the LED driver to the LED fixture, wherein the LED fixture has a hood, a set of power supply wires, and a set of LED socket wires. The system includes a socket, an LED driver, and an apparatus for electrically, thermally, mechanically, and interchangeably connecting the LED driver to the socket without having to wire the LED driver to the LED fixture. The socket mounts to the hood of the LED fixture, is electrically connected to the set of power supply wires of the LED fixture, and is electrically connected to the set of LED socket wires of the LED fixture. The LED driver is electrically, mechanically, and interchangeably connected to the socket so as to allow the LED driver to be replaced without having to wire the LED driver to the LED fixture.

13 Claims, 9 Drawing Sheets

Figure 1
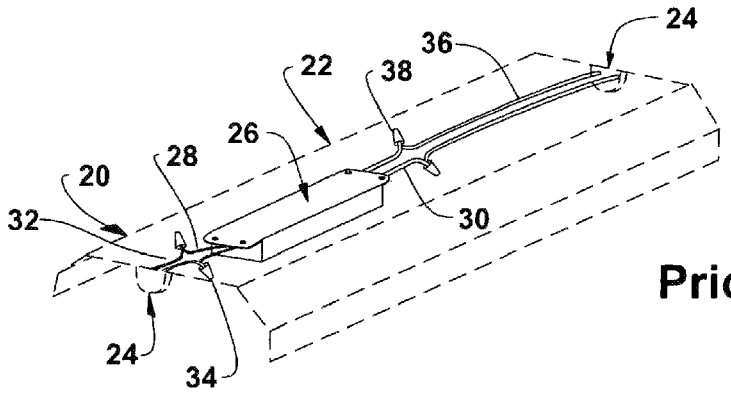
Prior Art
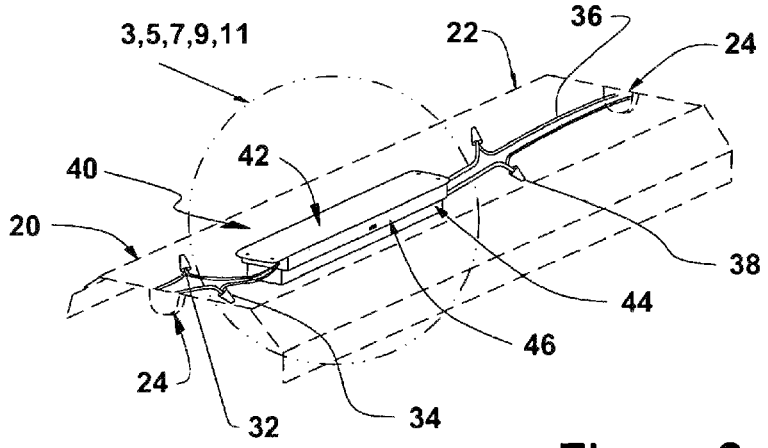
Figure 2

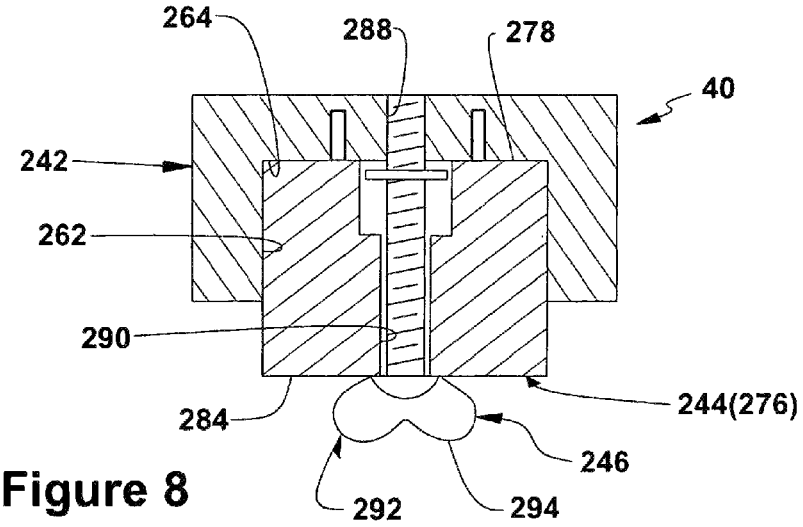
Figure 8
Figure 10
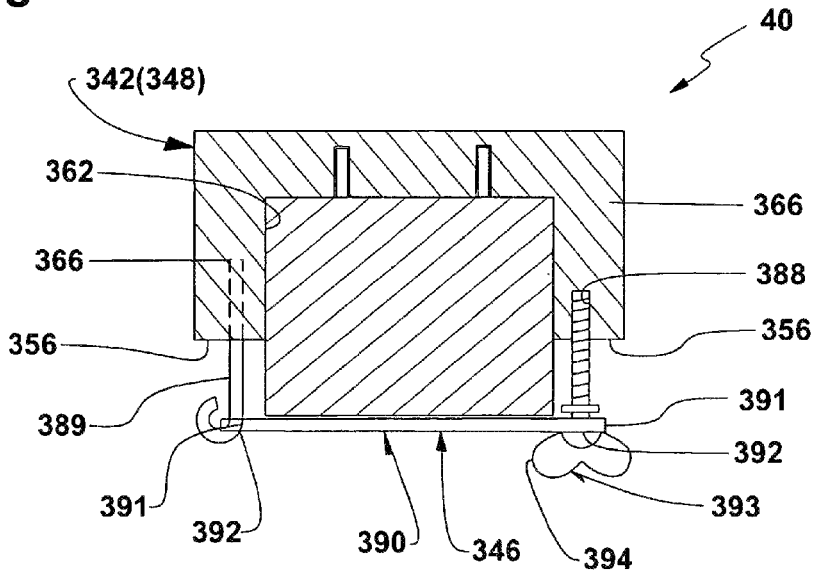

COOPERATING LED DRIVER AND SOCKET

RELATED APPLICATIONS

This patent application is a Non Provisional patent application of Provisional Patent Application 61/764,299, filed 13 Feb. 2013, the entirety of which is hereby incorporated by reference as if fully set forth below. This patent application is a Continuation in Part of patent application Ser. No. 13/199,176, which is a Non Provisional patent application of Provisional Patent Application 61/402,442, filed 30 Aug. 2010.

BACKGROUND OF THE INVENTION

The present invention is generally directed to a socket system for interchangeably securing LED driver circuits while providing for rapid and convenient replacement thereof for LED fixtures.

LED lamp systems generally have a number of specific operational requirements such as voltage, current, heat dissipation, light color, frequency, wavelength, color temperature, luminosity, light mixing, color rendering, and the like. The actual operational parameters are generally adjustable by varying voltage, current, duty cycle, wave form, and the like. LED lamps, if driven incorrectly may overheat leading to irreparable damage. To drive LEDs at the correct operational requirements, the operational parameters thereof are modulated generally based on feedback from the LED lamps. A driver circuit is employed for this purpose. Such driver circuit may include resistive loads, inductive coils, capacitors, switching transistors, clocks, and the like to modulate the operational parameters. During operation, LED lamps and their LED drivers experience a number of parasitic losses such as heat, vibration, radio frequency or electromagnetic interference, switching losses, and the like. Other environmental factors may influence their operation, such as ambient temperature, ambient light, humidity, air-flow, reflectivity of housing, and the like either responsive to sensed conditions or directly. Over time, the environmental factors and parasitic losses may contribute to decrease the operational performance of the LED lamps such that they may not meet the operational requirements. The LED driver, experiencing the voltage and current surges of the power supply, often needs replacement or upgrade towards new operational requirements.

Generally, to install an LED Driver, the power supply to the LED must be located, the driven LED lamps must be located as well, and then, at a point intermediate to the power supply and LED lamps, the positive and negative electric supply wires are cut and the LED driver spliced in to the power supply wires and the LED lamp wires. The conventional LED driver is mechanically secured to the LED lamp housing such as by a plurality of screws arranged around outside peripheral edges of the LED driver while a maintenance person holds the LED driver to the lamp housing and applies a driver to each screw. With increasingly complex LEDs and heightened operational requirements, the LED driver must more intelligently control the LED lamps. With such increased intelligence and command/control duties, an LED driver should have access to a number of often disparate sensor data. Some sensors may be placed proximate the LED lamps, some proximate the hood, some distally disposed to measure the environment and actual light output reaching an intended area. In some installations, the LED driver must also maintain batteries. With all of the remote sensors, comes additional complexity in connecting and disconnecting the LED driver.

When the LED driver fails, the process must be reversed and repeated. Mechanical coupling screws must be removed while ensuring that the LED driver does not fall; power supply wires, sensor wires, and lamp wires must be disconnected, any batteries should be disconnected, a new LED driver installed and re-spliced to each of the existing wires. With each successive splice and de-splice, each wire progressively wears requiring they be periodically clipped and reconditioned. Sometimes entire wires must be replaced.

In the past, LED drivers were mechanically coupled at several points around their periphery, such as by screws to retain the driver. This led to less than optimal thermal transfer from the LED driver to the dissipative LED housing. Vibrations and noise such as a hum or buzzing propagated to excessive levels due to the less than optimal mechanical coupling and dampening between LED driver and LED housing.

The pre-established screw holes in the LED housing often allowed water to seep through and damage the LED driver. Depending upon operating environment, penetrating water freezing to ice would force open any gaps in LED driver encapsulation hastening their degradation. Mechanical fatigue and delamination from the combination of environmental, chemical, and operational stresses can lead to short circuit, current overdraw, blown transistors, and even fires.

Depending upon operating environment, the normal byproduct heat may be minimized, or, in some environmental conditions, it may be necessary to capture and focus the heat, or even actively generate heat and transfer it to the environment in a certain predetermined fashion. For example, in LED installations along roadways, airports, ships, industrial/commercial freezers, refrigerators, patios, and other outdoor environments, heat from the LED lamps and LED drivers are harnessed to melt ice and maintain visibility of the LED light. Conventional screw fastener mechanisms result in substantial inefficiencies in both active and dissipative thermal transfer between LED driver and LED housing or LED lamps. Conventionally, a thermal paste or glue such as arctic silver conductive adhesive was used to thermally couple a heat generating part such as a central processing unit to a dissipating structure such as a heat sink.

In more benign environments, the LED housing is generally located in an elevated relation requiring awkward and unusual manipulations to access the LED lamps and LED driver for replacement, maintenance, or upgrade. For this reason, ladders, chairs, desks, and other ad hoc furnishings may be employed haphazardly, often resulting in injury.

Particularly in vocational and educational settings, improper LED driver installation lending to mechanical, vibrational, and acoustical emissions from the LED fixture cause acute mental distractions and pose as impediments to cognitive abilities. Reduced workload and increased health issues arise due to these occupational irritants such as flickering, noise, vibration, and errant emissions. Previous dampening solutions have proved inadequate.

There is therefore a need for a system by which LED drivers may be mechanically, electrically, and thermally coupled to LED fixtures while providing for convenient removal and replacement, amongst other features.

SUMMARY OF THE INVENTION

Thus, an object of the present invention is to provide a system for replacing an LED driver of an LED fixture without having to wire the LED driver to the LED fixture, which avoids some of the disadvantages of the prior art.

It is yet another object of the present invention to provide a system for secure mechanical, electrical, and thermal coupling of the LED driver to a light fixture while providing for convenient replacement.

Yet another object of the present invention is to provide a system for convenient replacement of the LED driver while suitably addressing transfer of heat, electrical power, sensor data, dampening of acoustic or EMI noise, and the like.

The various configurations of the present invention relate to a light emitting diode (LED) driver for an LED fixture, and more particularly, to a combination for expeditious replacement of an LED driver of an LED fixture without having to actuate a number of fasteners, disengage thermal couplings and acoustic dampeners, un-wire an old LED driver, and re-wire a replacement LED driver into the LED fixture every time an LED driver fails and is in need of replacement or upgrade. Such configurations also seek to securely couple the LED driver to the LED fixture for secure electrical, thermal, vibrational, and mechanical connection while providing for expeditious replacement of the LED driver without undue and inconvenient manipulations. To extend the operational life of the LED driver and, by extension, the LED lamps, the LED driver is securely coupled to the LED fixture housing while ensuring acceptable thermal transfer, electrical coupling, remote sensor accessibility, environmental protection, ease of access, along with the other operational requirements.

Briefly stated, another object of the present invention is to provide a combination for replacing an LED driver of an LED fixture without having to splice wires between the LED driver and the LED fixture, wherein the LED fixture generally has a hood, a set of power supply wires, and a set of LED socket wires as well as various remote sensors such as, for example, temperature sensors, light emission sensors, color temperature sensors, ambient light sensors, acoustic sensors, motion sensors, and the like. An exemplary combination includes a socket, an LED driver, and an apparatus for electrically, mechanically, thermally, and interchangeably connecting the LED driver to the socket without having to wire the LED driver to the LED fixture. An exemplary socket mounts to the hood of the LED fixture, is electrically spliced (or coupled) to the set of power supply wires of the LED fixture, and is electrically spliced (or coupled) to the set of LED socket wires of the LED fixture. The LED driver is electrically, mechanically, and interchangeably connected to the socket so as to allow the LED driver to be replaced without having to remove the electrical splices in wires and redo the splices for the replacement LED driver to interconnect with the LED fixture. Moreover the socket securely retains the LED driver but permits quick engagement or disengagement with the LED driver.

These and other objects are attained in a system formed in accordance with the disclosure for replacing a light emitting diode (LED) driver of an LED fixture without having to wire the LED driver to the LED fixture, wherein the LED fixture has a hood, a set of power supply wires, and a set of lamp socket wires. The system includes a socket; an LED driver; and a mechanism for electrically, mechanically, and interchangeably connecting said LED driver to said socket without having to wire said LED driver to the LED fixture. The socket is for mounting to the hood of the LED fixture and electrically splicing to the set of power supply wires of the fixture. The socket is also for electrically splicing to the set of lamp socket wires of the LED fixture. The LED driver is electrically, mechanically, and interchangeably connected to the socket so as to allow the LED driver to be replaced without having to wire said LED driver to the LED fixture.

An LED driver mounting system for replaceably securing an interchangeable LED driver in an LED lamp fixture to provide plural input and output couplings includes a fixed weight-bearing coupling operable to mechanically couple to an LED lamp fixture. The fixed weight-bearing coupling is configured to distribute a mechanical load on to the LED lamp fixture. At least one retentive wall member protrudes from the fixed weight-bearing coupling for decoupleably retaining an LED driver therein. The retentive wall member defines a receiving cavity with a plurality of intercoupling terminals therein to mechanically and electrically receive the LED driver. A fixed power supply intercoupling is operable to receive a supply power and provide it to at least one of the intercoupling terminals disposed within the receiving cavity. At least one fixed lamp intercoupling is operable to electrically couple at least one of the intercoupling terminals disposed within the receiving cavity with at least one LED in the LED lamp fixture.

BRIEF DESCRIPTION OF THE DRAWINGS

FIG. 1 is a diagrammatic perspective view of a typical prior art conventional LED fixture;

FIG. 2 is a diagrammatic perspective view of an exemplary embodiment of the present invention illustrating an LED driver interchangeably maintained in a retentive socket of an LED fixture;

FIG. 8 is an enlarged diagrammatic cross sectional view taken along LINE 8-8 in FIG. 7 but with the driver socket and the LED driver assembled together;

FIG. 10 is an enlarged diagrammatic cross sectional view taken along LINE 10-10 in FIG. 9 but with the driver socket and the LED driver assembled together;

LIST OF REFERENCE NUMERALS IN THE EXEMPLARY FIGURES

Figure 3:
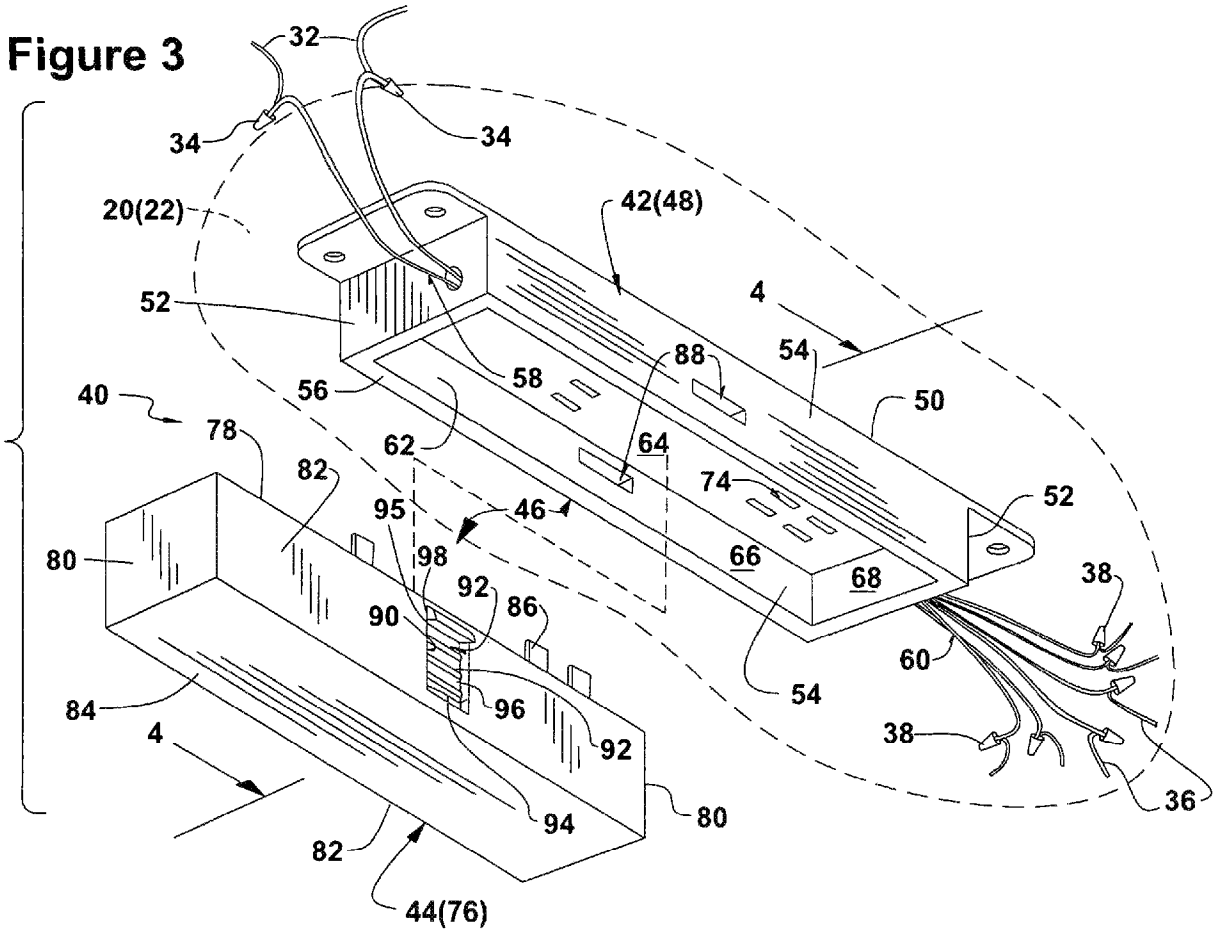
FIG. 3 is an enlarged exploded diagrammatic perspective view of the area generally enclosed by the dotted curve identified by ARROW 3 in FIG. 2 of a first illustrative configuration of the apparatus of the present invention.

20 LED fixture
22 hood of LED fixture 20

24 lamp sockets of LED fixture 20
26 LED driver of LED fixture 20
28 first set of wires of LED driver 26 of LED fixture 20
30 second set of wires of LED driver 26 of LED fixture 20
32 set of power supply wires of LED fixture 20
34 first wire nuts, shrink wrap, etc.
36 set of lamp socket wires of LED fixture 20
38 second wire nuts, shrink wrap, etc.
42 exemplary socket for mounting to hood 22 of LED fixture 20, and for electrically connecting to set of power supply wires 32 of LED fixture 20 and be protected by first wire nuts, crimp connectors, shrink wrap, etc. 34 and for electrically connecting to set of lamp socket wires 36 of LED fixture 20 and be protected by second wire nuts, crimp connectors, shrink wrap, etc. 38
44 exemplary LED driver
46 exemplary apparatus for electrically, mechanically, thermally, and interchangeably connecting LED driver 44 to socket 42 without having to wire LED driver 44 to LED fixture 20
48 body of socket 42
50 rear wall of body 48 of socket 42 for mounting to hood 22 of LED fixture 20
52 pair of end walls of body 48 of socket 42
54 pair of side walls of body 48 of socket 42
56 front wall of body 48 of socket 42
58 set of power supply/sensor wires of socket 42 for electrically connecting respectively to set of power supply wires 32 or sensors of LED fixture 20 to be protected by first wire nuts, crimp connectors, shrink wrap, terminals etc. 34
60 set of lamp socket/sensor wires of socket 42 for electrically connecting to set of lamp socket wires 36 of LED fixture 20 and be protected by second wire nuts, crimp connectors, shrink wrap, terminals etc. 38
62 chamber of socket 42
64 bottom wall defining chamber 62 of socket 42 for electrically, mechanically, acoustically, and thermally coupling with LED driver 44
66 pair of side walls defining chamber 62 of socket 42
68 pair of end walls defining chamber 62 of socket 42
70 first bore of one end wall of pair of end walls 52 of body 48 of socket 42
72 second bore of other end wall of pair of end walls 52 of body 48 of socket 42
74 plurality of electrical slots of socket 42
76 body of LED driver 44
78 rear wall of body 76 of LED driver 44
80 pair of end walls of body 76 of LED driver 44
82 pair of side walls of body 76 of LED driver 44
84 front wall of body 76 of LED driver 44
86 plurality of electrical blades of LED driver 44
88 pair of through slots of pair of side walls 66 defining chamber 62 of socket
42 of apparatus 46, respectively
90 pair of recessed portions of pair of side walls 82 of body 76 of LED driver 44 of apparatus 46, respectively
92 pair of tabs of apparatus 46
94 outer surfaces of pair of tabs 92 of apparatus 46, respectively
95 free ends of outer surfaces 94 of pair of tabs 92 of apparatus 46, respectively
96 first protrusions of pair of outer surfaces 94 of pair of tabs 92 of apparatus 46, respectively, form gripping areas for facilitating squeezing pair of tabs 92 of apparatus 46 into pair of recessed portions 90 of pair of side walls 82 of body 76 of LED driver 44 of apparatus 46, respectively
98 pair of second protrusions of pair of outer surfaces 94 of pair of tabs 92 of apparatus 46, respectively
142 socket
144 LED driver
146 apparatus
162 chamber of socket 142
166 pair of side walls defining chamber 162 of socket 142
176 body of LED driver 144
178 rear wall of body 176 of LED driver 144
182 pair of side walls of body 176 of LED driver 144
184 front wall of body 176 of LED driver 144
188 pair of through slots of pair of side walls 166 defining chamber 162 of socket 142 of apparatus 146, respectively
190 pair of recessed portions of pair of side walls 182 of body 176 of LED driver 144 of apparatus 146, respectively
192 pair of tabs of apparatus 146
193 free ends of pair of tabs 192 of apparatus 46, respectively
**193*a* pair of handles of pair of tabs 192 of apparatus 146**, respectively
194 pair of outer surfaces of pair of handles **193*a* of pair of tabs 192 of apparatus 146**, respectively
196 first protrusions of pair of outer surfaces 194 of pair of handles **193*a* of pair of tabs 192 of apparatus 146, respectively, form gripping areas for facilitating squeezing pair of handles 193*a* of pair of tabs 192 of apparatus 146 into pair of recessed portions 190 of pair of side walls 182 of body 176 of LED driver 144 of apparatus 146**, respectively
198 pair of second protrusions of pair of outer surfaces 194 of pair of tabs 192 of apparatus 146, respectively
242 socket
244 LED driver
246 apparatus
262 chamber of socket 242
264 bottom wall defining chamber 262 of socket 242
276 body of LED driver 244
278 rear wall of body 276 of LED driver 244
284 front wall of body 276 of LED driver 244
288 threaded bore of bottom wall 264 defining chamber 262 of socket 242 of apparatus 246
290 through bore of body 276 of LED driver 244 of apparatus 246
292 wing bolt of apparatus 246
294 wing head of wing bolt 292 of apparatus 246
342 socket
348 body of socket 342
356 front wall of body 348 of socket 342
362 chamber of socket 342
366 pair of side walls defining chamber 362 of socket 342
388 threaded bore of one side wall of pair of side walls 366 defining chamber
362 of socket 342 of apparatus 346
389 hook of other side wall of pair of side walls 366 defining chamber 362 of socket 342 of apparatus 346
390 bar of apparatus 346
391 pair of free ends of bar 390 of apparatus 346
392 pair of through bores of pair of free ends 391 of bar 390 of apparatus 346, respectively
393 wing bolt of apparatus 346
394 wing head of wing bolt 393 of apparatus 346
442 socket
444 LED driver
446 apparatus
462 chamber of socket 442
464 bottom wall defining chamber 462 of socket 442
468 pair of end walls defining chamber 462 of socket 442
476 body of LED driver 444
478 rear wall of body 476 of LED driver 444

480 pair of end walls of body 476 of LED driver 444

488 first pair of magnets of bottom wall 464 defining chamber 462 of socket 442 of apparatus 446

490 second pair of magnets of rear wall 478 of body 476 of LED driver 444 of apparatus 446

DETAILED DESCRIPTION OF THE PREFERRED EMBODIMENTS

Referring now to the figures, in which like numerals generally indicate like parts, and particularly to FIG. 1, which is a diagrammatic perspective view of a typical prior art conventional LED fixture. A typical prior art conventional LED fixture 20 includes a conventional hood 22, conventional LED sockets 24, and a conventional LED driver 26. The conventional LED sockets 24 of the typical prior art conventional LED fixture 20 are disposed in the conventional hood 22 of the typical prior art conventional LED fixture 20. The conventional LED driver 26 of the typical prior art conventional LED fixture 20 has a conventional first set of wires 28 extending from one end thereof and a conventional second set of wires 30 extending from the other side thereof. The conventional first set of wires 28 of the conventional LED driver 26 of the typical prior art conventional LED fixture 20 are spliced to a conventional set of power supply wires 32 of the typical prior art conventional LED fixture 20, and the splices are protected by conventional first wire nuts, shrink wrap, etc. 34. The conventional second set of wires 30 of the conventional LED driver 26 of the typical prior art conventional LED fixture 20 are spliced to a conventional set of LED socket wires 36 of the typical prior art conventional LED fixture 20, and the splices are protected by conventional second wire nuts, shrink wrap, etc. 38.

Turning to FIG. 2, which is a diagrammatic perspective view of an exemplary configuration of the present invention replacing an LED driver of an LED fixture without having to de-splice and re-wire or manipulate mechanical attachments, thermal couplings, acoustic dampeners, or sensor wires of the LED driver to the LED fixture.

The LED driver and mounting system 40 comprises a socket 42 and an LED driver 44. The socket 42 mounts to the hood 22 of the LED fixture 20, to be fixedly electrically interconnected to the set of power supply wires 32 of the LED fixture 20 on one hand and fixedly electrically connected to the LED socket wires 36 on the other hand. The socket 42 additionally couples thermally to the hood 22 on the one and to the LED driver 44 on the other to conduct heat away from the LED driver. Socket 42 may also provide interconnection between LED driver 44 and any sensors employed by the LED fixture such as a clock, temperature, ambient light sensor, or the like. The fixed electrical interconnections are preferably protected respectively by the first crimp connectors, wire nuts, shrink wrap, or the like 34 and 38 to ensure a reliable electrical interconnection to both the power supply wires 32 and the LED socket wires 36 of the LED fixture 20 in protected, fixed, and semi-permanent manner. The LED driver 44 is electrically, mechanically, and interchangeably connected to the socket 42 so as to allow the LED driver 44 to be replaced without having to disconnect the semi-permanent connections, mechanical, thermal, and acoustic couplings and rewire the replacement LED driver 44 to the LED fixture 20.

Figure 4:
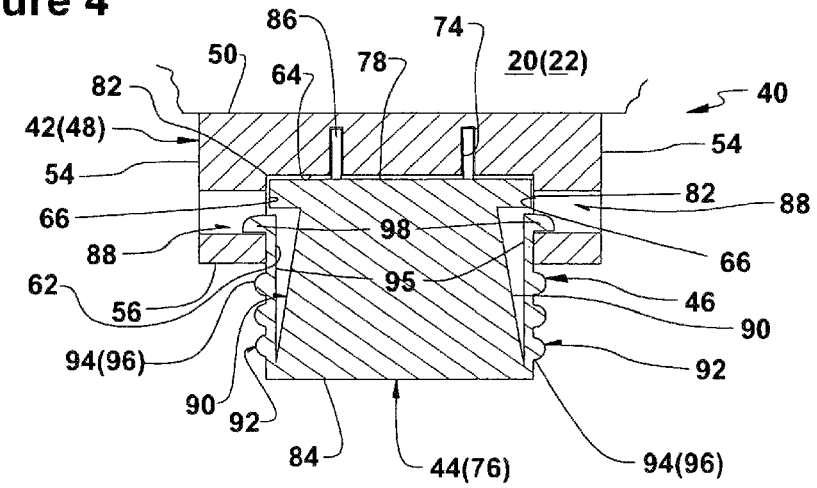
FIG. 4 is an enlarged diagrammatic cross sectional view taken along LINE 4-4 in FIG. 3 but with the exemplary socket and the LED driver assembled together in retentive manner for electrical and mechanical coupling.

The exemplary system 40 further comprises apparatus 46 for electrically, mechanically, and interchangeably connecting the LED driver 44 to the socket 42 without having to wire the LED driver 44 to the LED fixture 20. The socket 42, the LED driver 44, and a first configuration of the apparatus 46 can best be seen in FIGS. 3 and 4, which are, respectively, an enlarged exploded diagrammatic perspective view of the area generally enclosed by the dotted curve identified by ARROW 3 in FIG. 2 of a first configuration of the apparatus, and an enlarged diagrammatic cross sectional view taken along LINE 4-4 in FIG. 3 but with the socket and the LED driver assembled together, and as such, will be discussed with reference thereto.

The socket 42 comprises a body 48. The body 48 of the socket 42 is generally rectangular parallelepiped-shaped, and has a rear wall 50, a pair of end walls 52, a pair of side walls 54, and a front wall 56. The rear wall 50 of the body 48 of the socket 42 is for mounting to the hood 22 of the LED fixture 20 and preferably distributes the load as well as provides for thermal transfer of heat from the LED driver 44 to the hood 22. Additionally, the rear wall 50 may be coupled with intermediate acoustic dampening materials to prevent vibration or acoustic emissions from propagating to the hood 22.

The socket 42 further comprises a set of power supply wires 58. The set of power supply wires 58 of the socket 42 extend outwardly from one end wall 52 of the body 48 of the socket 42, are for electrically splicing to the set of power supply wires 32 of the LED fixture 20, and have the splices protected by the crimping connectors, first wire nuts, shrink wrap, etc. 34. One or more of the power supply wires 58 may be used for remote sensing or data or remote sensors may use separate sensor/data lines. For example, in battery powered installations, an additional battery sense line to identify operational parameters of the battery such as voltage, current, heat, and the like may be employed. Such sensor data may be sent and received by the LED driver 44 via the power supply wires 58, the LED socket wires 60, by separate wires, or wirelessly. Indeed, any measures for providing LED driver 44 with operational or environmental information may be employed.

The socket 42 further comprises at least one set of LED socket wires 60. The set of LED socket wires 60 of the socket 42 extend outwardly from the other end wall 52 of the body 48 of the socket 42, are for electrically connecting to the set of LED socket wires 36 of the LED fixture 20, and have the connections protected by the second crimp connectors, wire nuts, shrink wrap, etc. 38.

The socket 42 in a preferred configuration further comprises a chamber 62. The chamber 62 of the socket 42 extends inwardly from, and opens into, the front wall 56 of the body 48 of the socket 42, to short of the rear wall 50 of the body 48 of the socket 42. The chamber 62 of the socket 42 is generally rectangular parallelepiped-shaped, similarly to that of the body 48 of the socket 42 but smaller, and is defined by a bottom wall 64, a pair of side walls 66, and a pair of end walls 68.

The one end wall 52 of the body 48 of the socket 42 has a first bore 70. The first bore 70 of the one end wall 52 of the body 48 of the socket 42 has the set of power supply wires 58 of the socket 42 extending outwardly therethrough for electrically connection such as by crimping or splicing to the set of power supply wires 32 of the LED fixture 20 and have the connections protected by the crimp connectors, first wire nuts, shrink wrap, etc. 34. Alternatively, a plurality of terminals may be arranged to receive power supply wires 58 for mechanical and electrical connection therewith.

The other end wall 52 of the body 48 of the socket 42 has a second bore 72. The second bore 72 of the other end wall 52 of the body 48 of the socket 42 has the set of LED socket wires 60 of the socket 42 extending outwardly therethrough for electrically connection to the set of LED socket wires 36 of the LED fixture 20 and have the connections protected by the second crimp connectors, wire nuts, shrink wrap, etc. 38. Alternatively, a plurality of terminals may be arranged to receive LED socket wires 36 for mechanical and electrical connection therewith.

The socket 42 further comprises a plurality of electrical slots 74. The plurality of electrical slots 74 of the socket 42 extend in the bottom wall 64 defining the chamber 62 of the socket 42, and selected ones thereof electrically communicate with selected ones of the set of power supply wires 58 of the socket 42 and the set of LED socket wires 60 of the socket 42. Alternatively, bump pads, solder balls, terminals, surface contacts and the like may be used for the electrical slots 74 to make interconnections between the LED driver 44 and the power supply wires 32, sensor wires, and LED socket wires 36. Electrical slots 74 are not limited to the bottom wall 64, but may disposed on one or more other faces of the socket 62 such as internal wall 66 or 68.

Bottom wall 64 may have compressible dampening measures such as foam pads, rubber feet, or other such measures to isolate or attenuate vibrations from the LED driver 44. Bottom wall 64 and any of side walls 66, 68 may be made of or include a heat conductive material to facilitate heat transfer from the LED driver 44.

The LED driver 44 comprises a body 76. The body 76 of the LED driver 44 is generally rectangular parallelepiped-shaped, and has a rear wall 78, a pair of end walls 80, a pair of side walls 82, and a front wall 84. Body 76 is preferably electrically insulative around it's periphery to protect handlers. However, at least one surface is preferably heat conductive to further heat transfer from the LED driver 44 to the socket 62 and on for dissipation to the hood 22 or other such structure with ample surface area to dissipate such heat. In some installations, the heat may be channeled from the LED driver 44 to an area around the LED lamps to maintain visibility or prevent accumulation of ice or condensation.

The body 76 of the LED driver 44 is snugly and interchangeably received in the chamber 62 of the socket 42, with the pair of side walls 82 of the body 76 of the LED driver 44 abutting against the pair of side walls 66 defining the chamber 62 of the socket 42, respectively, with the pair of end walls 80 of the body 76 of the LED driver 44 abutting against the pair of end walls 68 defining the chamber 62 of the socket 42, respectively, and with the rear wall 78 of the body 76 of the LED driver 44 abutting against the bottom wall 64 defining the chamber 62 of the socket 42.

In a preferred configuration, the pair of side walls 82 of the body 76 of the LED driver 44 extend higher than the pair of side walls 66 defining the chamber 62 of the socket 42, respectively, and the pair of end walls 80 of the body 76 of the LED driver 44 extend higher than the pair of end walls 68 defining the chamber 62 of the socket 42, respectively, so as to provide an area to be gripped when the LED driver 44 is interchangeably engaging the socket 42.

The LED driver 44 further comprises a plurality of electrical blades 86. The plurality of electrical blades 86 of the LED driver 44 extend from the rear wall 78 of the body 76 of the LED driver 44, and engage cooperatively in the plurality of electrical slots 74 of the socket 42, respectively, so as to electrically communicate the LED driver 44 with the set of power supply wires 58 of the socket 42, various sensor wires, and the set of LED socket wires 60 of the socket 42, and thereby allow, once the socket 42 is one-time, and one-time only, wired into the LED fixture 20, the LED driver 44 to be repetitively replaced without having to wire the LED driver 44 to the LED fixture 20. The electrical blades 86 may be disposed on any suitable face of body 76 provided that the plurality of electrical slots 74 of socket 62 are similarly repositioned to correspond and register with the electrical blades 86. Electrical blades 86 and electrical slots 74 may be replaced with terminals and pins, resilient contact members, sockets and plugs, solder bumps, golden fingers, or any other electrically mating pair of connectors that provide suitable electrical and/or data connection between the LED driver 44 and socket 62, sensor, power supply, and LED lamp wires.

In the first configuration, the apparatus 46 includes the pair of side walls 66 defining the chamber 62 of the socket 42 having a pair of through slots 88 extending axially therethrough, respectively. The pair of through slots 88 of the pair of side walls 66 defining the chamber 62 of the socket 42 of the apparatus 46 are generally rectangular-shaped, and are disposed midway along the pair of side walls 66 defining the chamber 62 of the socket 42, respectively. Alternatively, recessed cut-outs that do not pass entirely through the side wall 66 may be employed provided that they suitably engage and retain the protrusions 98 of the body 76 to provide sure mechanical coupling therebetween.

The apparatus 46 further includes the pair of side walls 82 of the body 76 of the LED driver 44 having a pair of recessed portions 90, respectively. The pair of recessed portions 90 of the pair of side walls 82 of the body 76 of the LED driver 44 of the apparatus 46 taper from the front wall 84 of the body 76 of the LED driver 44 to short of the rear wall 78 of the of the body 76 of the LED driver 44, are disposed midway along the pair of side walls 82 of the body 76 of the LED driver 44, respectively, and are a same general length as, and are positioned in alignment with, the pair of through slots 88 of the pair of side walls 66 defining the chamber 62 of the socket 42 of the apparatus 46, respectively.

The apparatus 46 further includes a pair of tabs 92. The pair of tabs 92 of the apparatus 46 are livingly hinged in the pair of recessed portions 90 of the pair of side walls 82 of the body 76 of the LED driver 44 of the apparatus 46, respectively, in close proximity to the front wall 84 of the body 76 of the LED driver 44, so as to allow the pair of tabs 92 of the apparatus 46 to pivot in and out of the pair of recessed portions 90 of the pair of side walls 82 of the body 76 of the LED driver 44 of the apparatus 46, respectively.

The pair of tabs 92 of the apparatus 46 have a pair of outer surfaces 94 with free ends 95, respectively. The pair of outer surfaces 94 of the pair of tabs 92 of the apparatus 46 have first protrusions 96 thereon, respectively. The first protrusions 96 of the pair of outer surfaces 94 of the pair of tabs 92 of the apparatus 46 extend axially along the pair of outer surfaces 94 of the pair of tabs 92 of the apparatus 46, respectively, are vertically spaced-apart, and form gripping areas for facilitating squeezing the pair of tabs 92 of the apparatus 46 into the pair of recessed portions 90 of the pair of side walls 82 of the body 76 of the LED driver 44 of the apparatus 46, respectively.

The free ends 95 of the pair of outer surfaces 94 of the pair of tabs 92 of the apparatus 46 have thereon a pair of second protrusions 98, respectively. The pair of second protrusions 98 of the pair of outer surfaces 94 of the pair of tabs 92 of the apparatus 46 extend axially along the pair of outer surfaces 94 of the pair of tabs 92 of the apparatus 46, respectively, and selectively engage in the pair of through slots 88 of the pair of side walls 66 defining the chamber 62 of the socket 42 of the apparatus 46, respectively, and when the gripping areas of the pair of tabs 92 of the apparatus 46 are squeezed, the LED driver 44 is inserted into the socket 42, released, and the pair of second protrusions 98 of the pair of outer surfaces 94 of the pair of tabs 92 of the apparatus 46 engage in the pair of through slots 88 of the pair of side walls 66 defining the chamber 62 of the socket 42 of the apparatus 46, respectively, and thereby electrically, mechanically, and interchangeably connecting the LED driver 44 to the socket 42 without having to wire the LED driver 44 to the LED fixture 20.

Figure 6:
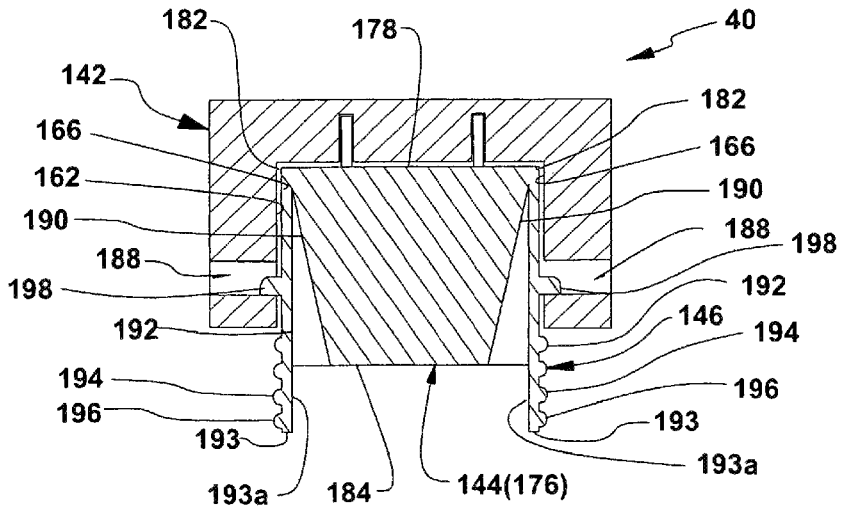
FIG. 6 is an enlarged diagrammatic cross sectional view taken along LINE 6-6 in FIG. 5 but with an illustrative driver socket and an LED driver assembled together.
Figure 5:
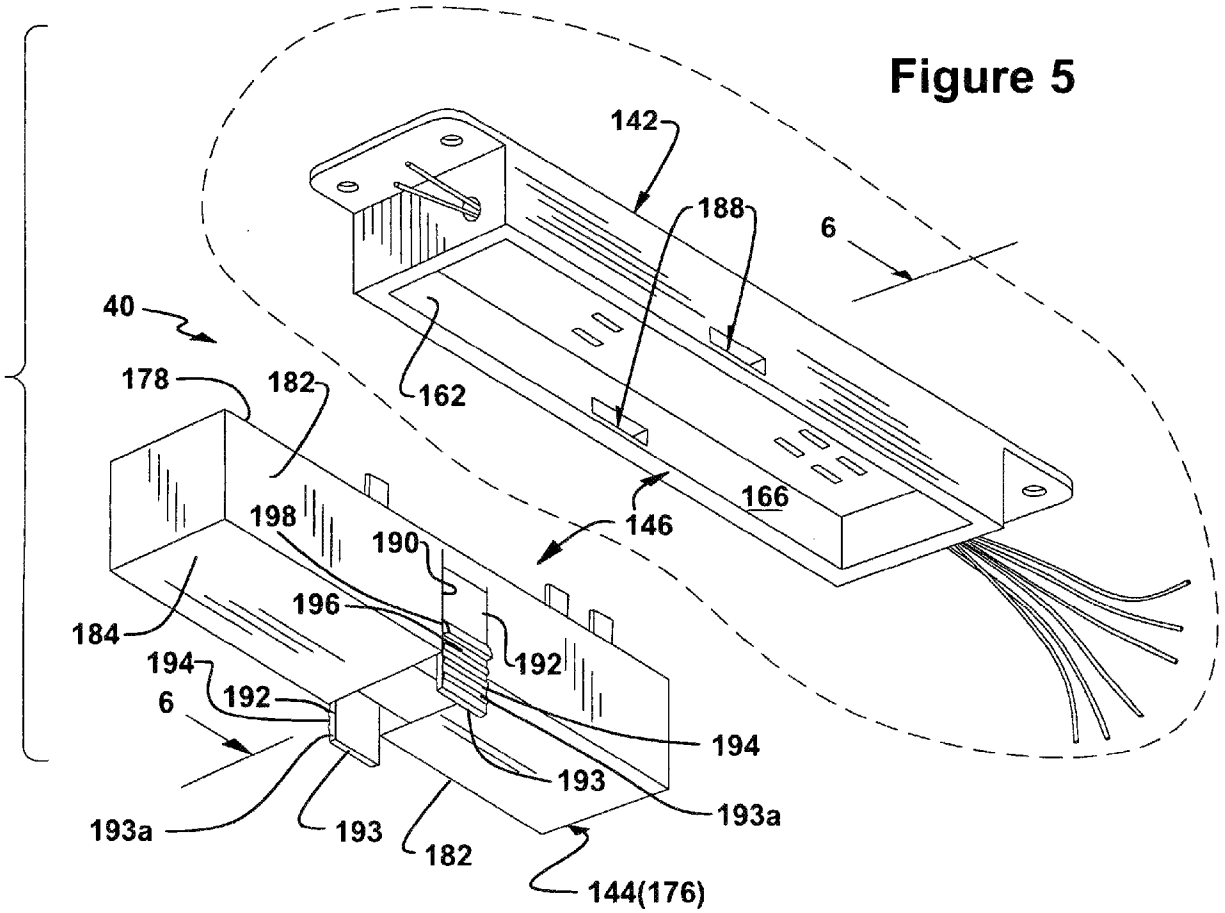
FIG. 5 is an enlarged exploded diagrammatic perspective view of the area generally enclosed by the dotted curve identified by ARROW 5 in FIG. 2 of a second exemplary configuration of the driver socket and LED driver for mechanical and electrical coupling.

A second exemplary configuration of the apparatus 146 can best be seen in FIGS. 5 and 6, which are, respectively, an enlarged exploded diagrammatic perspective view of the area generally enclosed by the dotted curve identified by ARROW 5 in FIG. 2 of a second configuration of the apparatus 146, and an enlarged diagrammatic cross sectional view taken along LINE 6-6 in FIG. 5 but with the socket and the LED driver assembled together, and as such, will be discussed with reference thereto.

The apparatus 146 includes the pair of side walls 166 defining the chamber 162 of the socket 142 having a pair of through slots 188 extending axially therethrough, respectively. The pair of through slots 188 of the pair of side walls 166 defining the chamber 162 of the socket 142 of the apparatus 146 are generally rectangular-shaped, and are disposed midway along the pair of side walls 166 defining the chamber 162 of the socket 142, respectively. As discussed above, recessed portions, or any other shape for securely mating with protrusions 198 may be employed which do not necessarily pass entirely through side walls 166.

The apparatus 146 further includes the pair of side walls 182 of the body 176 of the LED driver 144 having a pair of recessed portions 190, respectively. The pair of recessed portions 190 of the pair of side walls 182 of the body 176 of the LED driver 144 of the apparatus 146 diverge from, and open into, the front wall 184 of the body 176 of the LED driver 144, to short of the rear wall 178 of the body 176 of the LED driver 144, are disposed midway along the pair of side walls 182 of the body 176 of the LED driver 144, respectively, and are a same general length as, and are positioned in alignment with, the pair of through slots 188 of the pair of side walls 166 defining the chamber 162 of the socket 142 of the apparatus 146, respectively.

The apparatus 146 further includes a pair of tabs 192. The pair of tabs 192 of the apparatus 146 are livingly hinged in the pair of recessed portions 190 of the pair of side walls 182 of the body 176 of the LED driver 144 of the apparatus 146, respectively, in close proximity to the rear wall 178 of the body 176 of the LED driver 144, so as to allow the pair of tabs 192 of the apparatus 146 to pivot in and out of the pair of recessed portions 190 of the pair of side walls 182 of the body 176 of the LED driver 144 of the apparatus 146, respectively.

The pair of tabs 192 of the apparatus 146 extend past the front wall 184 of the body 176 of the LED driver 144 to free ends 193 so as to form a pair of handles 193*a*, respectively. Such handles 193 may be slidingly engaged with the body 176 so as to retract for storage.

The pair of handles 193*a* of the pair of tabs 192 of the apparatus 146 have a pair of outer surfaces 194, respectively. The pair of outer surfaces 194 of the pair of handles 193*a* of the pair of tabs 192 of the apparatus 146 have first protrusions 196 thereon, respectively. The first protrusions 196 of the pair of outer surfaces 194 of the pair of handles 193*a* of the pair of tabs 192 of the apparatus 146 extend axially along the pair of outer surfaces 194 of the pair of handles 193*a* of the pair of tabs 192 of the apparatus 146, respectively, are vertically spaced-apart, and form gripping areas for facilitating squeezing the pair of handles 193*a* of the pair of tabs 192 of the apparatus 146 into the pair of recessed portions 190 of the pair of side walls 182 of the body 176 of the LED driver 144 of the apparatus 146, respectively.

The pair of outer surfaces 194 of the pair of tabs 192 of the apparatus 146 have thereon a pair of second protrusions 198, respectively. The pair of second protrusions 198 of the pair of outer surfaces 194 of the pair of tabs 192 of the apparatus 146 extend axially along the pair of outer surfaces 194 of the pair of tabs 192 of the apparatus, respectively, are disposed about midway on the pair of outer surfaces 194 of the pair of tabs 192 of the apparatus, respectively, and selectively engage in the pair of through slots 188 of the pair of side walls 166 defining the chamber 162 of the socket 142 of the apparatus 146, respectively, and when the gripping areas of the pair of handles 193*a* of the pair of tabs 192 of the apparatus 146 are squeezed, the LED driver 144 is inserted into the socket 142, released, and the pair of second protrusions 198 of the pair of outer surfaces 194 of the pair of tabs 192 of the apparatus 146 engage in the pair of through slots 188 of the pair of side walls 166 defining the chamber 162 of the socket 142 of the apparatus 146, respectively, and thereby electrically, mechanically, and interchangeably connecting the LED driver 144 to the socket 142 without having to wire the LED driver 144 to the LED fixture 20.

Figure 7:
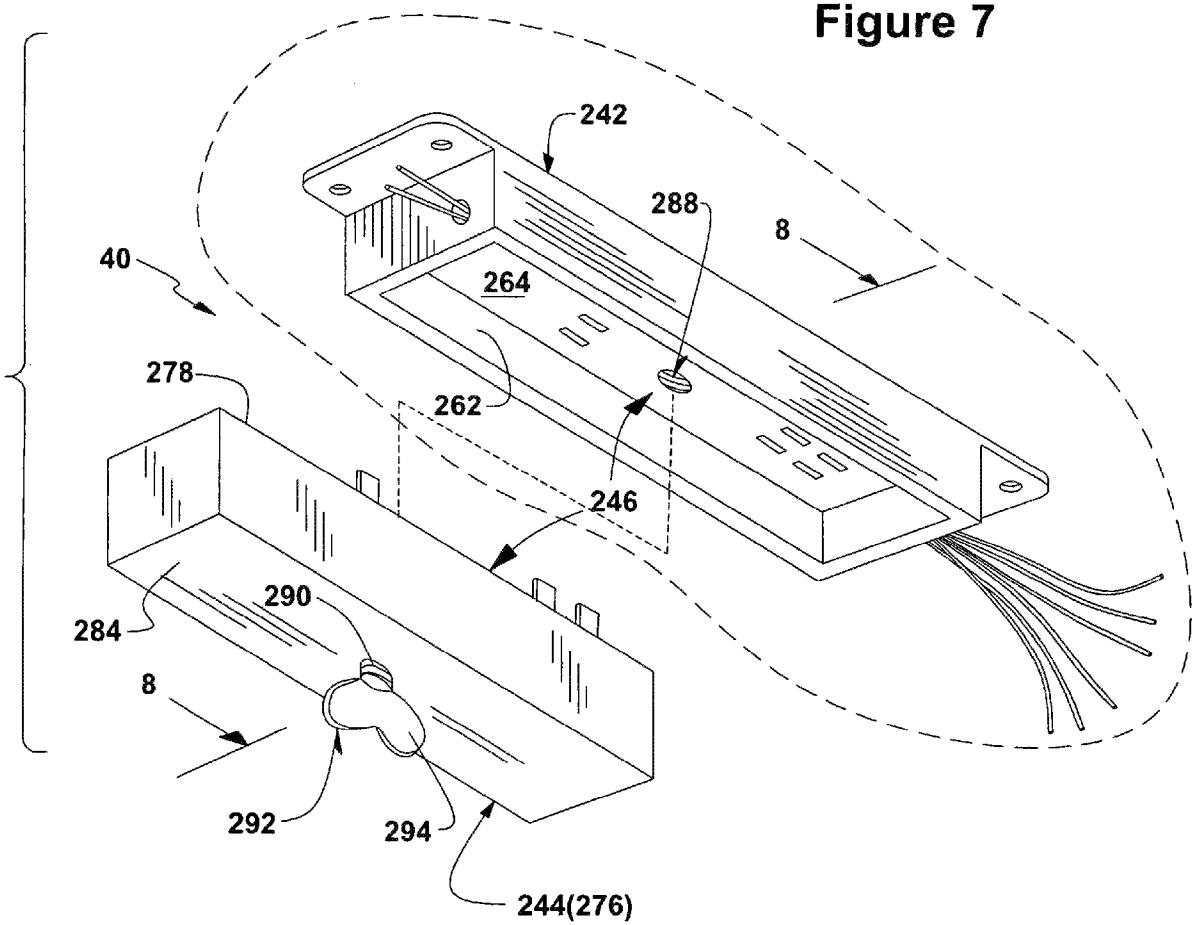
FIG. 7 is an enlarged exploded diagrammatic perspective view of the area generally enclosed by the dotted curve identified by ARROW 7 in FIG. 2 of a third exemplary configuration of the driver socket and LED driver.

An exemplary third configuration of the apparatus 246 can best be seen in FIGS. 7 and 8, which are, respectively, an enlarged exploded diagrammatic perspective view of the area generally enclosed by the dotted curve identified by ARROW 7 in FIG. 2 of a third configuration of the apparatus 246, and an enlarged diagrammatic cross sectional view taken along LINE 8-8 in FIG. 7 but with the socket and the LED driver assembled together, and as such, will be discussed with reference thereto.

The apparatus 246 includes the bottom wall 264 defining the chamber 262 of the socket 242 having a threaded bore 288 extending therethrough. The threaded bore 288 of the bottom wall 264 defining the chamber 262 of the socket 242 of the apparatus 246 is disposed midway along the bottom wall 264 defining the chamber 262 of the socket 242 of the apparatus 246.

The apparatus 246 further includes the body 276 of the LED driver 244 having a through bore 290. The through bore 290 of the body 276 of the LED driver 244 of the apparatus 246 extends from the front wall 284 of the body 276 of the LED driver 244 to the rear wall 278 of the body 276 of the LED driver 244, is disposed midway along the body 276 of the LED driver 244 of the apparatus 246, and is positioned in alignment with the threaded bore 288 of the bottom wall 264 defining the chamber 262 of the socket 242 of the apparatus 246.

The apparatus 246 further includes a wing bolt 292. The wing bolt 292 of the apparatus 246 extends freely through the through bore 290 of the body 276 of the LED driver 244 of the apparatus 246, selectively threadably into the threaded bore 288 of the bottom wall 264 defining the chamber 262 of the socket 242 of the apparatus 246, and has a wing head 294 that forms a gripping area for facilitating threading the wing bolt 292 of the apparatus 246 into the threaded bore 288 of the bottom wall 264 defining the chamber 262 of the socket 242 of the apparatus 246, and when the LED driver 244 is inserted into the socket 242 and the wing bolt 292 of the apparatus 246 is tightened into the threaded bore 288 of the bottom wall 264 defining the chamber 262 of the socket 242 of the apparatus 246, the LED driver 244 is thereby electrically, mechanically, and interchangeably connected to the socket 242 without having to wire the LED driver 244 to the LED fixture 20. Any suitable type of bolt or fastener with a user engageable head (with or without a driver tool) may be employed.

Figure 9:
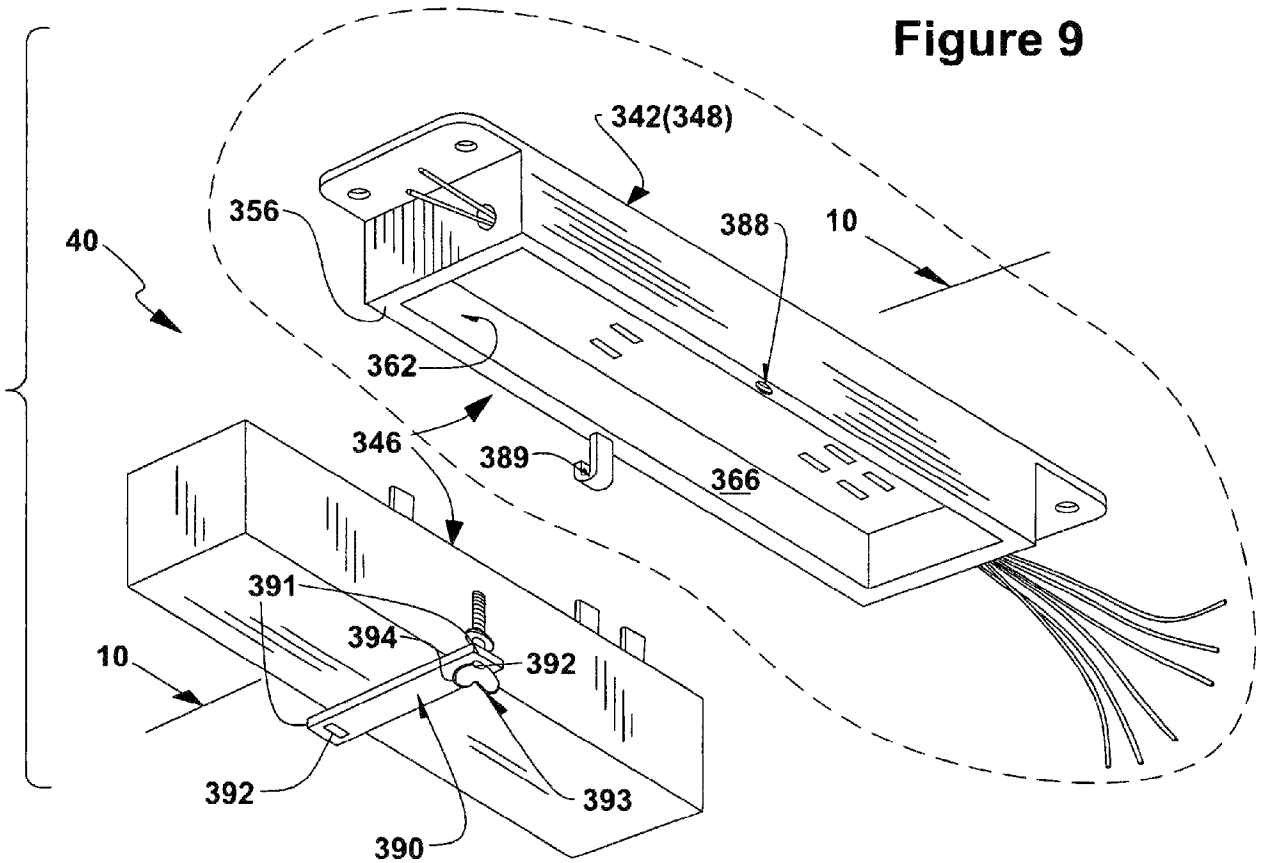
FIG. 9 is an enlarged exploded diagrammatic perspective view of the area generally enclosed by the dotted curve identified by ARROW 9 in FIG. 2 of an exemplary fourth configuration.

An exemplary fourth configuration of the apparatus 346 can best be seen in FIGS. 9 and 10, which are, respectively, an enlarged exploded diagrammatic perspective view of the area generally enclosed by the dotted curve identified by ARROW 9 in FIG. 2 of a fourth configuration of the apparatus 346, and an enlarged diagrammatic cross sectional view taken along LINE 10-10 in FIG. 9 but with the socket and the LED driver assembled together, and as such, will be discussed with reference thereto.

The apparatus 346 includes the pair of side walls 366 defining the chamber 362 of the socket 342 having a threaded bore 388 and a hook 389, respectively. The threaded bore 388 of one side wall 366 defining the chamber 362 of the socket 342 of the apparatus 346 extends midway on the one side wall 366 defining the chamber 362 of the socket 342 and inwardly from a direction of the front wall 356 of the body 348 of the socket 342. The hook 389 of the other side wall 366 defining the chamber 362 of the socket 342 of the apparatus 346 extends midway on the other side wall 366 defining the chamber 362 of the socket 342 and outwardly from a direction of the front wall 356 of the body 348 of the socket 342.

The apparatus 346 further includes a bar 390. The bar 390 of the apparatus 346 has a pair of free ends 391. The pair of free ends 391 of the bar 390 of the apparatus 346 have a pair of through bores 392, respectively. The apparatus 346 further includes a wing bolt 393. The wing bolt 393 of the apparatus 346 has a wing head 394, and selectively engages in the threaded bore 388 of the one side wall 366 defining the chamber 362 of the socket 342 of the apparatus 346.

One through bore 392 of one free end 391 of the bar 390 of the apparatus 346 is pivotally engaged by the hook 389 of the other side wall 366 defining the chamber 362 of the socket 342 of the apparatus 346. The other through bore 392 of the other free end 391 of the bar 390 of the apparatus 346 receives the wing bolt 393 of the apparatus 346, and when the LED driver 344 is inserted into the chamber 362 of the socket 342 and the bar 390 of the apparatus 346 is pivoted onto the front wall 384 of the body 376 of the LED driver 344, the wing bolt 393 of the apparatus 346 is threaded into the threaded bore 388 of the one side wall 366 defining the chamber 362 of the socket 342 of the apparatus 346 and tightened, and thereby electrically, mechanically, and interchangeably connecting the LED driver 344 to the socket 342 without having to wire the LED driver 344 to the LED fixture 20.

Figure 11:
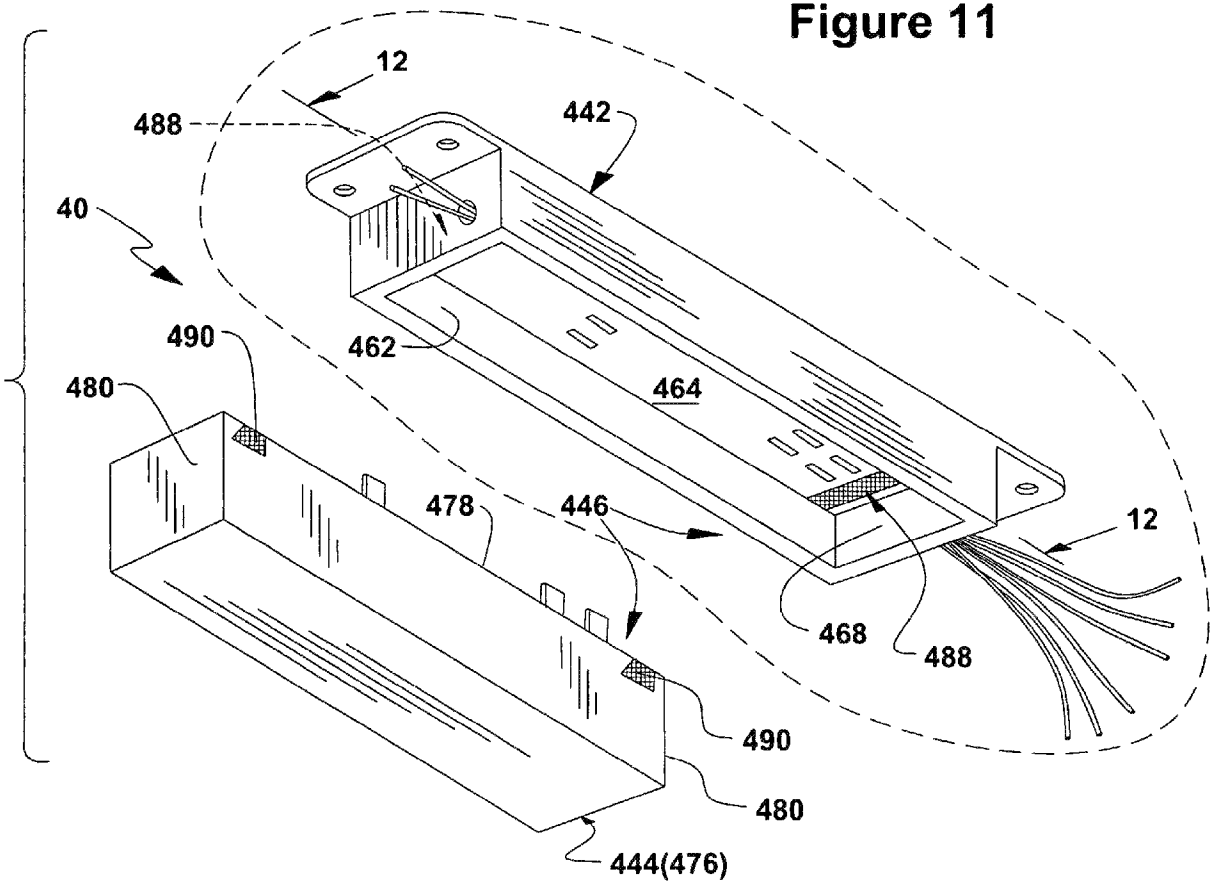
FIG. 11 is an enlarged exploded diagrammatic perspective view of the area generally enclosed by the dotted curve identified by ARROW 11 in FIG. 2 of a fifth exemplary configuration.
Figure 12:
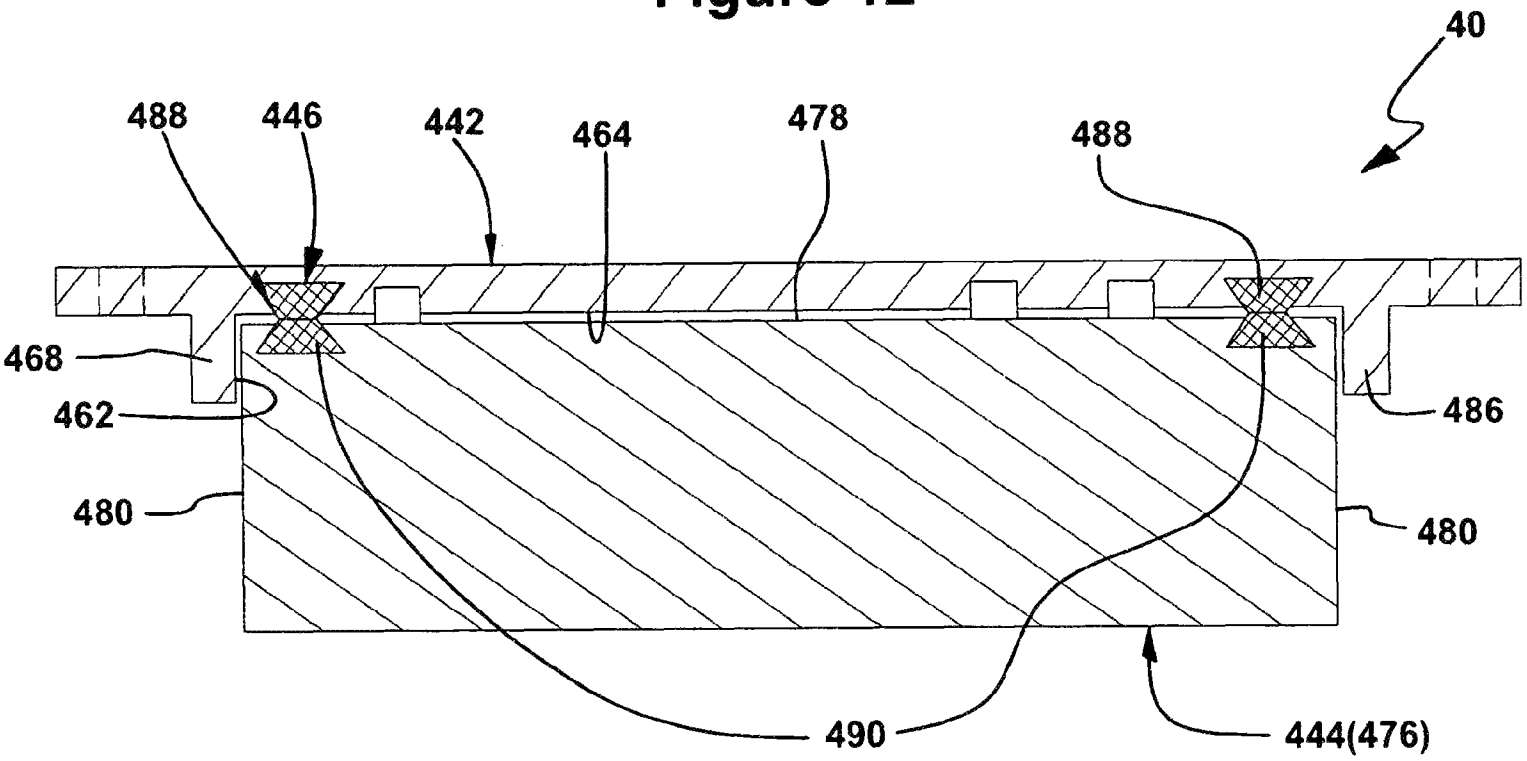
FIG. 12 is an enlarged diagrammatic cross sectional view taken along LINE 12-12 in FIG. 11 but with the driver socket and LED driver assembled together.

An exemplary fifth configuration of the apparatus 446 can best be seen in FIGS. 11 and 12, which are, respectively, an enlarged exploded diagrammatic perspective view of the area generally enclosed by the dotted curve identified by ARROW 11 in FIG. 2 of a fifth configuration of the apparatus 446, and an enlarged diagrammatic cross sectional view taken along LINE 12-12 in FIG. 11 but with the socket 462 and the LED driver 444 assembled together, and as such, will be discussed with reference thereto.

The apparatus 446 includes the bottom wall 464 defining the chamber 462 of the socket 442 of the apparatus 446 having a first pair of magnets 488 that are generally flush in the bottom wall 464 defining the chamber 462 of the socket 442. The first pair of magnets 488 of the bottom wall 464 defining the chamber 462 of the socket 442 of the apparatus 446 are disposed adjacent to the pair of end walls 468 defining the chamber 462 of the socket 442, respectively. However, the magnets 488 may be disposed centrally to the socket 462 provided that the magnets 490 of the body 444 are also similarly situated.

The apparatus 446 further includes the rear wall 478 of the body 476 of the LED driver 444 having a second pair of magnets 490 that is generally flush in the rear wall 478 of the body 476 of the LED driver. The second pair of magnets 490 of the rear wall 478 of the body 476 of the LED driver 444 of the apparatus 446 are disposed adjacent to the pair of end walls 480 of the body 476 of the LED driver 444, respectively, and when the LED driver 444 is inserted into the chamber 462 of the socket 442, the second pair of magnets 490 of the rear wall 478 of the body 476 of the LED driver 444 of the apparatus 446 are attracted to the first pair of magnets 488 of the bottom wall 464 defining the chamber 462 of the socket 442 of the apparatus 446, and thereby electrically, mechanically, and interchangeably connecting the LED driver 444 to the socket 442 without having to wire the LED driver 444 to the LED fixture 20.

It will be understood that each of the elements described above or two or more together may also find a useful application in other types of constructions differing from the types described above.

While the various configurations of the present invention have been illustrated and described as embodied in a combination for replacing an LED driver of a LED fixture without having to wire the LED driver to the LED fixture, however, they are not limited to the details shown, since it will be understood that various omissions, modifications, substitutions, and changes in the forms and details of the various configurations of the present invention illustrated and their operation can be made by those skilled in the art without departing in any way from the spirit of the present invention. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above and the appended claims, along with their full range of equivalents.

What is claimed is:

1. A system for replacing a light emitting diode (LED) driver of an LED fixture without having to wire the LED driver to the LED fixture, wherein the LED fixture has a hood, a set of power supply wires, and a set of lamp socket wires, comprising:

a) a socket;

b) an LED driver; and c) a mechanism for electrically, mechanically, and interchangeably connecting said LED driver to said socket without having to wire said LED driver to the LED fixture; wherein said socket is mounted to the hood of the LED fixture; said socket being electrically connected to the set of power supply wires of the fixture, said socket being electrically connected to the set of lamp socket wires of the LED fixture, said LED driver being electrically, mechanically, and interchangeably connected to said socket for permitting said LED driver to be replaced without having to wire said LED driver to the LED fixture;

wherein said socket comprises a body, said body of said socket being substantially a rectangular parallelepiped-shape, said body of said socket including a) a rear wall, b) a pair of end walls, c) a pair of side walls, and d) a front wall, said rear wall of said body of said socket being mounted to the hood of the LED fixture, said socket including a set of power wires and a set of lamp socket wires;

wherein said set of power supply wires of said socket extend outwardly from one end wall of said body of said socket; and wherein said set of power supply wires of said socket being connected to the set of power supply wires of the LED fixture;

wherein said set of lamp socket wires of said socket extend outwardly from the other end wall of said body of said socket; and wherein said set of lamp socket wires of said socket being connected to the set of lamp socket wires of the LED fixture;

wherein a chamber of said socket extends inwardly from said front wall of said body of said socket to short of said rear wall of said body of said socket;

wherein said chamber of said socket is generally rectangular parallelepiped-shaped, similarly to that of said body of said socket but smaller; and wherein said chamber of said socket is defined by: a) a bottom wall; b) a pair of side walls; and c) a pair of end walls;

wherein a plurality of electrical slots formed in said socket extend in said bottom wall defining said chamber of said socket; wherein selected ones of said plurality of electrical slots of said socket electrically communicate with selected ones of said set of power supply wires of said socket, whereby selected ones of said plurality of electrical slots of said socket electrically communicate with selected ones of said set of lamp socket wires of said socket wherein said LED driver comprises a body; wherein said body of said LED driver being substantially a rectangular parallelepiped-shape; and wherein said body of said LED driver has: a) a rear wall; b) a pair of end walls; c) a pair of side walls; and d) a front wall; and wherein said pair of side walls of said body of said LED driver extend higher than said pair of side walls defining said chamber of said socket and said pair of end walls of said body of said LED driver extend higher than said pair of end walls defining said chamber of said socket so as to provide an area to be gripped when said LED driver is interchangeably engaging said socket, said LED driver including a plurality of electrical blades.

2. The system as recited in claim 1, wherein said pair of end walls of said body of said socket have a first bore and a second bore extending therethrough respectively.

3. The system as recited in claim 2, wherein first and second bores of said body of said socket have said set of power supply wires and said lamp socket wires respectively of said socket extending outwardly therethrough for electrically connecting to the set of power supply wires and the set of lamp socket wires of the LED fixture.

4. The system as recited in claim 1, wherein said plurality of electrical blades of said LED driver extend from said rear wall of said body of said LED driver, said plurality of electrical blades of said LED driver engage cooperatively in said plurality of electrical slots of said socket respectively, so as to electrically communicate said LED driver with said set of power supply wires of said socket and said set of lamp socket wires of said socket, and thereby allow, once said socket is one-time wired into the LED fixture, said LED driver to be repetitively replaced without having to wire said LED driver to the LED fixture.

5. The system as recited in claim 1 including a pair of through slots extending through said pair of side walls defining said chamber of said socket of said mechanism, said through slots are substantially rectangular-shaped, and said pair of through slots of said pair of side walls defining said chamber of said socket of said mechanism are disposed along said pair of side walls defining said chamber of said socket, respectively.

6. The system as recited in claim 5, including a pair of recessed portions of said pair of side walls of said body of said LED driver of said mechanism taper from said front wall of said body of said LED driver to short of said rear wall of said of said body of said LED driver.

7. The system as recited in claim 6, wherein said pair of recessed portions of said pair of side walls of said body of said LED driver of said mechanism are a same general length as said pair of through slots of said pair of side walls defining said chamber of said socket of said mechanism, respectively; and, wherein said pair of recessed portions of said pair of side walls of said body of said LED driver of said mechanism are positioned in alignment with said pair of through slots of said pair of side walls defining said chamber of said socket of said mechanism, respectively.

8. The system as recited in claim 6, having a pair of tabs of said mechanism which are livingly hinged in said pair of recessed portions of said pair of side walls of said body of said LED driver of said mechanism, respectively, in close proximity to said front wall of said body of said LED driver so as to allow said pair of tabs of said mechanism to pivot in and out of said pair of recessed portions of said pair of side walls of said body of said LED driver of said mechanism, respectively.

9. The system as recited in claim 8, wherein said pair of tabs of said mechanism have a pair of outer surfaces, respectively, said pair of outer surfaces of said pair of tabs of said mechanism having free ends respectively; and wherein said pair of outer surfaces of said pair of tabs of said mechanism have first protrusions thereon.

10. The system as recited in claim 8, wherein said first protrusions of said pair of outer surfaces of said pair of tabs of said mechanism extend axially along said pair of outer surfaces of said pair of tabs of said mechanism, respectively, said first protrusions of said pair of outer surfaces of said pair of tabs of said mechanism being vertically spaced-apart, said first protrusions of said pair of outer surfaces of said pair of tabs of said mechanism form gripping areas for facilitating squeezing said pair of tabs of said mechanism into said pair of recessed portions of said pair of side walls of said body of said LED driver of said mechanism respectively.

11. The system as recited in claim 9, including a pair of second protrusions of said pair of outer surfaces of said pair of tabs of said mechanism extending axially along said pair of outer surfaces of said pair of tabs of said mechanism, respectively, said pair of second protrusions of said pair of outer surfaces of said pair of tabs of said mechanism for selectively engaging in said pair of through slots of said pair of side walls defining said chamber of said socket of said mechanism respectively, and when said gripping areas of said pair of tabs of said mechanism are squeezed, said LED driver is insertable into said socket and said pair of second protrusions of said pair of outer surfaces of said pair of tabs of said mechanism engage in said pair of through slots of said pair of side walls defining said chamber of said socket of said mechanism respectively, thereby electrically, mechanically, and interchangeably connecting said LED driver to said socket without having to wire said LED driver to the LED fixture.

12. A system for replacing a light emitting diode (LED) driver of an LED fixture without having to wire the LED driver to the LED fixture, wherein the LED fixture has a hood, a set of power supply wires, and a set of lamp socket wires, comprising:

a) a socket;

b) an LED driver; and c) a mechanism for electrically, mechanically, and interchangeably connecting said LED driver to said socket without having to wire said LED driver to the LED fixture; wherein said socket is mounted to the hood of the LED fixture; said socket being electrically connected to the set of power supply wires of the fixture, said socket being electrically connected to the set of lamp socket wires of the LED fixture, said LED driver being electrically, mechanically, and interchangeably connected to said socket for permitting said LED driver to be replaced without having to wire said LED driver to the LED fixture;

wherein said socket comprises a body, said body of said socket being substantially a rectangular parallelepiped-shape, said body of said socket including a) a rear wall, b) a pair of end walls, c) a pair of side walls, and d) a front wall, said rear wall of said body of said socket being mounted to the hood of the LED fixture, said socket including a set of power wires and a set of lamp socket wires;

wherein said set of power supply wires of said socket extend outwardly from one end wall of said body of said socket; and wherein said set of power supply wires of said socket being connected to the set of power supply wires of the LED fixture;

wherein said set of lamp socket wires of said socket extend outwardly from the other end wall of said body of said socket; and wherein said set of lamp socket wires of said socket being connected to the set of lamp socket wires of the LED fixture;

wherein a chamber of said socket extends inwardly from said front wall of said body of said socket to short of said rear wall of said body of said socket;

wherein said chamber of said socket is generally rectangular parallelepiped-shaped, similarly to that of said body of said socket but smaller; and wherein said chamber of said socket is defined by: a) a bottom wall; b) a pair of side walls; and c) a pair of end walls;

wherein a plurality of electrical slots formed in said socket extend in said bottom wall defining said chamber of said socket; wherein selected ones of said plurality of electrical slots of said socket electrically communicate with selected ones of said set of power supply wires of said socket, whereby selected ones of said plurality of electrical slots of said socket electrically communicate with selected ones of said set of lamp socket wires of said socket; and wherein said LED driver comprises a body; wherein said body of said LED driver being substantially a rectangular parallelepiped-shape; and wherein said body of said LED driver has: a) a rear wall; b) a pair of end walls; c) a pair of side walls; and d) a front wall; including a pair of through slots of said pair of side walls defining said chamber of said socket of said mechanism are generally rectangular-shaped, said pair of through slots of said pair of side walls defining said chamber of said socket of said mechanism are disposed midway along said pair of side walls defining said chamber of said socket respectively, said side walls of said body of said LED driver having a pair of recessed portions respectively.

13. The system as recited in claim 12, wherein said mechanism includes a pair of tabs of said mechanism which are livingly hinged in said pair of recessed portions of said pair of side walls of said body of said LED driver of said mechanism, respectively, in close proximity to said rear wall of said body of said LED driver so as to allow said pair of tabs of said mechanism to pivot in and out of said pair of recessed portions of said pair of side walls of said body of said LED driver of said mechanism, respectively.

* * * * *